United States Patent [19]

Kurz

[11] 4,072,341

[45] Feb. 7, 1978

[54] ADJUSTABLE CHAIR

[75] Inventor: Rudolf Kurz, Bietigheim-Bissingen, Germany

[73] Assignee: Kurz GmbH, Bietigheim, Germany

[21] Appl. No.: 636,709

[22] Filed: Dec. 1, 1975

[30] Foreign Application Priority Data

Dec. 3, 1974 Germany ..... 7440096[U]

[51] Int. Cl.[2] ..... A47C 4/00

[52] U.S. Cl. ..... 297/27; 297/359; 267/179

[58] Field of Search ..... 259/28, 27, 304, 359, 259/300, 17, 372, 379; 267/179

[56] References Cited

U.S. PATENT DOCUMENTS

| | | | |
|---|---|---|---|
| Re. 6,641 | 9/1875 | Hunzinger | 297/28 |
| 329,941 | 11/1885 | Parks | 297/28 |
| 1,539,225 | 5/1925 | West et al. | 297/27 X |
| 2,195,091 | 3/1940 | Lorenz et al. | 297/27 |
| 2,675,059 | 4/1954 | Martin | 297/28 X |
| 2,847,060 | 8/1958 | Pearlstine | 297/359 |
| 3,333,863 | 8/1967 | Bishop | 267/179 |

FOREIGN PATENT DOCUMENTS

| | | | |
|---|---|---|---|
| 716,571 | 10/1966 | Italy | 297/28 |

*Primary Examiner*—Marion Parsons, Jr.
*Assistant Examiner*—Peter A. Aschenbrenner
*Attorney, Agent, or Firm*—Michael J. Striker

[57] ABSTRACT

An adjustable chair as a seat, a backrest pivoted on the seat for movement between an erect and an reclined position, and a leg rest mounted on the seat for movement between a retracted and an extended position. The seat is mounted on lateral portions of a frame for pivoting so that the angular position of the backrest relative to the frame may be changed either by pivoting the backrest relative to the seat, or by pivoting the seat relative to the frame. A damping arrangement damps the movement of the backrest relative to the frame at least between some of the angular positions of the backrest, and an arresting arrangement including interengaging teeth is accommodated in an armrest pivoted on the backrest, which arrangement permits arresting the backrest in a selected one of the angular positions thereof. The damping arrangement includes a helical spring accommodated in the armrest and having one end connected to the backrest and a free end into which a connecting rod connected to a lateral portion of the frame extends, the connecting rod and the spring having cooperating abutments which engage one another within a certain range of movement of the backrest so that the spring is tensioned and thus damps the movement of the backrest. A connecting member is pivotably mounted on one of the lateral portions and has a closed elongated slot, and the seat has a projecting member which is received and guided in the elongated slot, whereby the seat is limited to movement between a substantially horizontal and an inclined position.

17 Claims, 7 Drawing Figures

ADJUSTABLE CHAIR

BACKGROUND OF THE INVENTION

The present invention relates to an adjustable chair in general, and more particularly to a chair which can be converted into a cot by changing the inclination of the backrest relative to the seat.

There are already known various constructions of adjustable chairs of the type here under consideration. In one type of the adjustable chair constructions, a seat is arranged between a pair of lateral portions of a frame, and a backrest is connected to the seat for pivoting relative thereto between an erect position and a fully reclined position. A leg rest is connected to the seat for pivoting between a retracted position and an extended position, and a connecting arrangement connects the backrest with the leg rest so that they simultaneously move between their respective positions. Thus, when the backrest is in its erect position, the leg rest is in its retracted position so that the person using the adjustable chair can use it as a chair, whereas the leg rest assumes its extended position when the backrest is in its fully reclined position so that the user of the adjustable chair can assume a prostrate position thereon. A pair of armrests is pivoted on the backrest, and the respective armrest is provided with a plurality of teeth arranged in a row and extending toward the upper portion of the associated lateral portion of the frame on which there is provided an arresting tooth which engages the teeth of the row so as to arrest the backrest in its respective angular position relative to the frame. The pivoting movement of the armrest relative to the backrest results either in disengagement or in engagement of the detent tooth with the teeth of the row so as to enable the user of the adjustable chair to change the angular position of the backrest relative to the frame.

In the adjustable chairs of the above-mentioned type, the user of the adjustable chair has to subject the backrest to an adjusting force when it is desired to change the angular position of the backrest, such force being attributable to the weight of the user of the adjustable chair. It will be appreciated that the part of the weight of the user which is applied to the backrest will increase with the increasing angle which the backrest assumes with respect to the vertical. This, of course, is disadvantageous inasmuch as, on the one hand, the force applied to the backrest increasingly exceeds the force which is necessary for adjusting the angular position of the backrest and, on the other hand and as a result of the former, the speed with which the backrest approaches its fully reclined position increases with decreasing angle between the instantaneous position and the fully reclined position. One disadvantage of this increasing speed of movement of the backrest is that it is increasingly difficult to arrest the backrest in a selected position as the frame approaches the fully reclined position thereof. Also, the interengagement of the arresting teeth becomes increasingly hard because of the increasing inertial and other forces which are to be overcome in order to stop the backrest in its partially reclined position. Thus, not only are the interengaging teeth subject to a high degree of wear, but also some discomfort is felt by the user of the adjustable chair as a result of the deceleration of the backrest to a sudden stop. This is particularly true when the user holds the armrests provided with the arresting teeth and lifts the armrests in their disengaging positions so that the backrest performs its movement from the erect position or from one of the intermediate positions all the way to the fully reclined position. In this situation, the final abutment provided at the armrest and cooperating with the tooth provided on the lateral portion of the frame abuts against such detent tooth with full force, and the pivoting of the backrest is suddenly stopped from a high speed with a considerable impact. Such a quick pivoting of the backrest and such a sudden stop thereof may scare the user of the adjustable chair, particularly when the user is unfamiliar with the adjustable chair and with the operation thereof. This is particularly unacceptable in view of the fact that, more likely than not, the adjustable chair will be used by an older person. Also, the increased wear of the cooperating arresting teeth resulting from the substantial impacts which occur during the interengagement of the teeth to arrest the backrest in the desired position, particularly when such desired position is close to the fully reclined position, results in reduced useful life of the adjustable chair, which is also undesirable.

SUMMARY OF THE INVENTION

Accordingly, it is a general object to avoid the disadvantages of the prior art adjustable chairs.

More particularly, it is an object of the present invention to provide an adjustable chair the backrest of which can be pivoted between an erect position and a fully reclined position without substantial impacts.

It is a further object of the present invention to provide an adjustable chair having an arrangement for arresting the backrest in a selected pivoted position, in which the wear of the arresting arrangement is substantially reduced compared to conventional arresting arrangements.

It is a concomitant object of the present invention to provide an adjustable chair which is simple in construction and reliable in operation.

Still another object of the invention is to provide an adjustable chair which can be more easily and more comfortably adjusted.

In pursuance of these objects and others which will become apparent hereafter, one feature of the present invention resides, briefly stated, in an adjustable chair, in a combination which comprises a frame, a backrest, means for connecting the backrest to the frame for movement between a plurality of angular positions relative to the frame, and means for damping the movement of the backrest to at least some of the angular positions.

The damping means may be of a variety of constructions, and there are many ways in which the damping means can be arranged relative to the adjustable chair. However, in a currently preferred embodiment of the present invention, the damping means includes two damping arrangements each of which is associated with and extends between a respective armrest and a lateral portion of the frame which is associated with and supports the respective armrest.

An especially simple and reliable construction of the present invention is obtained when the damping arrangement includes a helical spring, one end of which is associated to and cooperates with the respective armrest and the other end of which cooperates with the associated lateral portion of the frame. The helical spring may be accommodated in a guiding recess and may abut against the respective portions of the armrest, on the one hand, and of the lateral portion of the frame, on the other hand, the helical spring acting as a compression spring which is compressed as the backrest moves toward its fully reclined position so that the spring damps the movement of the backrest toward the reclined position.

In a currently preferred embodiment of the present invention, however, the helical spring is accommodated in a guide channel of the respective armrest, and acts as a tension spring in that one of the ends of the helical spring is connected to the armrest in the rear region thereof, preferably at the pivot which connects the armrest to the backrest, and in that the other end of the helical spring cooperates with the associated lateral portion of the frame, and more particularly with a detent tooth which is rigid with the lateral portion of the frame and extends therefrom into the guide channel of the armrest in which there is provided a row of teeth which form with one another a plurality of detent recesses in a selected one of which the detent tooth of the lateral portion of the frame can be received to determine the partially or fully reclined position of the backrest.

It is also proposed according to a further currently preferred embodiment of the present invention that the damping arrangement including the helical tension spring be so constructed that the damping arrangement commences its operation only after the backrest has been pivoted to a certain extent toward the fully reclined position thereof. When this is to be achieved, it must be assured that the tension spring is not extended to tensioned as long as the armrest which is connected to the backrest conducts initial movements associated with the initial movement of the backrest toward the reclined position. For this reason, the damping arrangement is so constructed, according to a further preferred embodiment of the present invention, that a connecting rod which is attached to the lateral portion of the frame and more particularly to the detent tooth thereof is telescopically received in the interior of the tension spring, and that the tension spring and the connecting rod have abutments which are out of contact with one another as long as the armrest conducts the initial part of its movement, after which the abutments engage one another, which results in extension and tensioning of the tension spring during the further movement of the armrest, which is associated with further movement of the backrest toward its fully reclined position.

According to a further currently preferred embodiment of the present invention, the backrest of the adjustable seat can be arrested in a plurality of partially reclined positions during the initial part of the movement of the backrest from its erect position toward its reclined position whereas the further movement of the backrest towards its fully reclined position takes place in a stepless manner. This means that the user of such an adjustable chair is unable to arrest the backrest in any of the partially reclined positions within the further range; rather, the backrest will softly move toward its final fully reclined position due to the action of the damping means. In addition thereto, the respective position of the backrest relative to the frame can be selected by the user of the adjustable chair by shifting his center of gravity so that the backrest is subjected to different forces which extend the tension spring to different extents against the biasing force exerted thereby, which results in the backrest assuming different positions.

The present invention can be used to advantage in such adjustable chairs in which each of the lateral portions of the frame is comprised of two leg members which are connected to one another at the upper regions thereof for pivoting relative to one another and in which a reinforcing member extends between and connects the leg members to one another. In such adjustable chairs, the seat of the chair may be mounted on the reinforcing members by means of laterally extending pivots. Each reinforcing member may be pivotally connected to the leg members so that the leg members can be moved relative to one another between a collapsed position in which the leg members are adjacent to one another and substantially coextensive, and an operative position assumed when the adjustable chair is being used, the reinforcing member preventing further movement of the leg members apart beyond the operative position. When the seat of the adjustable chair is mounted on the reinforcing members for pivoting relative to the frame, it is necessary to prevent the seat from pivoting in frontward direction beyond a substantially horizontal position. Therefore, an abutment may be provided on the reinforcing member which cooperates with the seat to support the same in the substantially horizontal position and to prevent tilting thereof frontwardly of such position.

In the adjustable chairs of this construction in which the seat is mounted on the lateral portions of the frame for pivoting relative to the frame, it is necessary to limit the extent of the movement of the seat in the rearward direction from the initial substantially horizontal position to an inclined position assumed by the seat relative to the frame. This is particularly necessary in order to assure that, in the final position of the seat, the seat, the backrest and the possibly present leg rest assume and remain in a definite predetermined angular position relative to one another. The limitation of movement of the seat to between the substantially horizontal position and the fully inclined position can be achieved in a very simple manner by providing a connecting element which is pivoted at the front leg of the lateral portion of the frame, which connecting element is accommodated between the lateral portion of the frame and the adjacent portion of the seat, the connecting element being formed with an elongated closed slot in which there is accommodated and guided a projecting portion of the seat. Thus, when the seat is tilted from its substantially horizontal position toward its final inclined position, the projecting portion of the seat will be guided in the elongated closed slot of the connecting element which will simultaneously pivot about its axis, until the projecting portion of the seat reaches the end of the elongated slot of the connecting element, upon which the connecting element prevents any further movement of the seat beyond the fully inclined position assumed thereby. It may also be desirable to preselect the extent to which the seat can be pivoted in rearward direction from its substantially horizontal position, and it is proposed according to a further concept of the present invention to achieve this result by accommodating a setting screw of a conventional construction in the elongated slot of the connecting element, which setting screw can be moved between and arrested in a plurality of positions within the range permitted by the configuration of the slot of the connecting element. In this manner, an effective length of the slot in the connecting element for movement of the projecting portion of the seat element may be adjusted.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
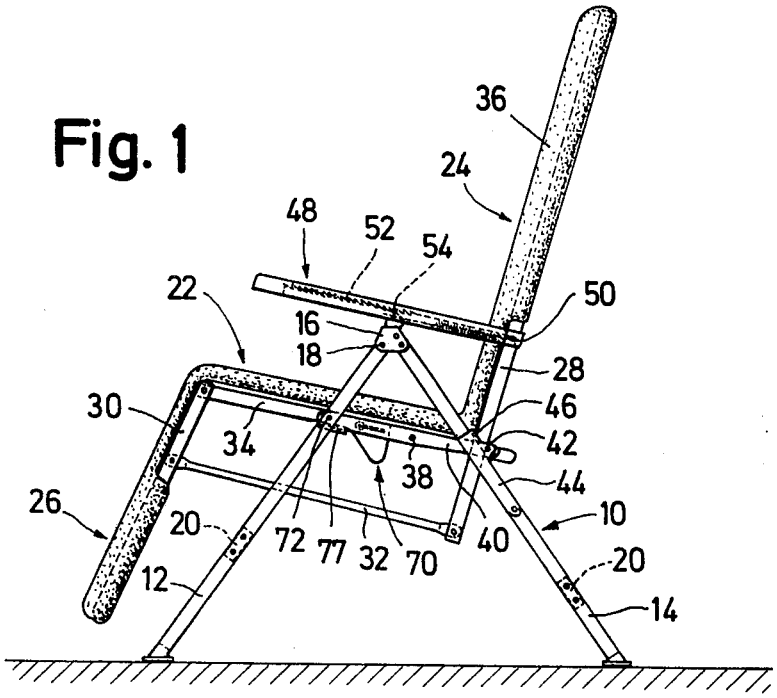
FIG. 1 is a side elevational view of the adjustable chair of the present invention in its normal sitting position.
Figure 2:
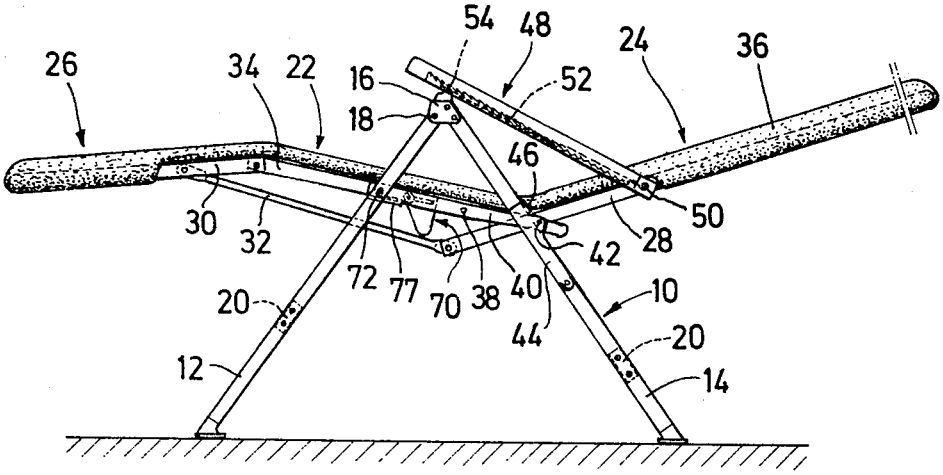
FIG. 2 is a view corresponding to FIG. 1 but with the backrest in its fully reclined position and the leg rest in its extended position.
Figure 3:
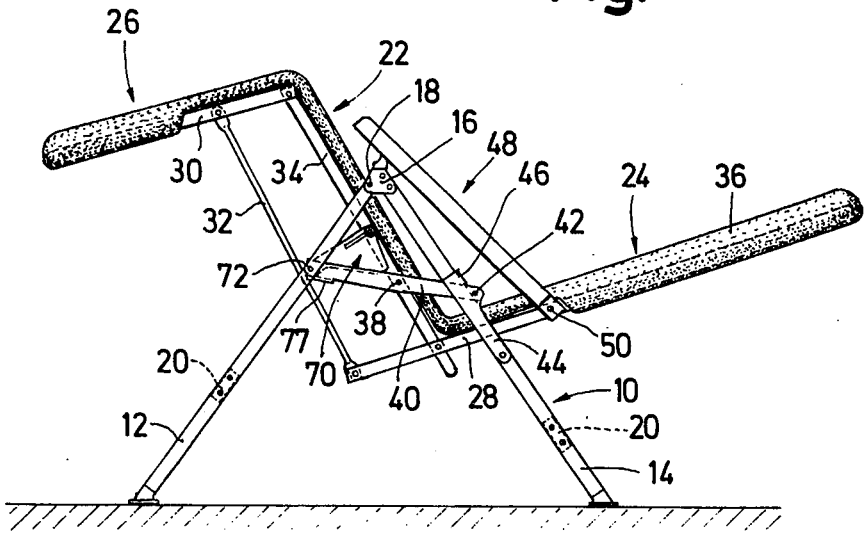
FIG. 3 is a view similar to FIG. 1 with the seat in its fully inclined position.

Referring now to the drawings, and first to FIGS. 1 to 3 thereof, it may be seen therein that the adjustable seat has a frame which includes two lateral portions 10 which are spaced from one another in direction normal to the plane of the drawing. Each of the lateral portions 10 includes a front leg member 12 and a rear leg member 14 which enclose an acute angle with one another and are connected to one another at their upper ends as seen in the drawing. For connecting the leg members 12 and 14, there is connected to the rear leg member 14, in the upper region thereof, a bracket 16; and a pivot 18 connects the front leg member 12 to the bracket 16.

The leg members 12 and 14 of the two lateral portions 10 are respectively connected with one another by means of crossties 20, so as to maintain the lateral portions 10 at a predetermined distance from one another. A seat 22 is arranged between the two lateral portions 10, which seat 22 is equipped with a backrest 24 at one of its ends and with a leg rest 26 at the other end. The backrest 24 as well as the leg rest 26 are connected to the seat 22 for pivoting relative thereto. It is currently preferred that the backrest 24, on the one hand, and the leg rest 26, on the other hand, include U-shaped frame parts, wherein the frame part of the backrest 24 includes lateral portions 28 and the leg rest 26 has lateral portions 30. The lateral portions 28 and 30 can be connected with one another by means of connecting ties 32 which assure simultaneous movement of the backrest 24 and the leg rest 26. A cushioning cover 36 covers the U-shaped frame portions of the backrest 24 and the leg rest 26, as well as frame portions 34 of the seat 22. A reinforcing member 40 of each of the lateral portions 10 of the frame of the adjustable chair is connected at its front end to the front leg member 12, and at its rear end to a free end of a pivoting lever 44 which is pivoted on the rear leg member 14. Lateral pivots 38 mount the seat 22 on the reinforcing member 40 for pivoting. The pivoting lever 44 is formed with a laterally extending abutment 46 which, when the lateral portion 10 of the frame of the adjustable chair is in its illustrated operative position, abuts against the rear leg member 14 and thus prevents the lever 44 as well as the front leg member 12 which is connected thereto by the reinforcing member 40 from moving beyond the illustrated position.

Figure 4:
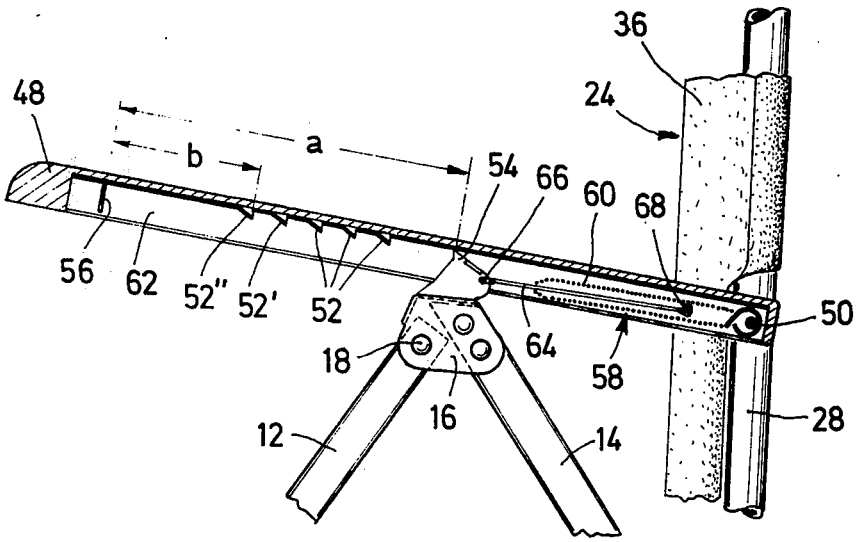
FIG. 4 is a fragmentary sectional view illustrating one embodiment of the arresting and damping arrangement of the present invention as accommodated within the armrest in a position assumed when the seat is its position illustrated in FIG. 1.
Figure 5:
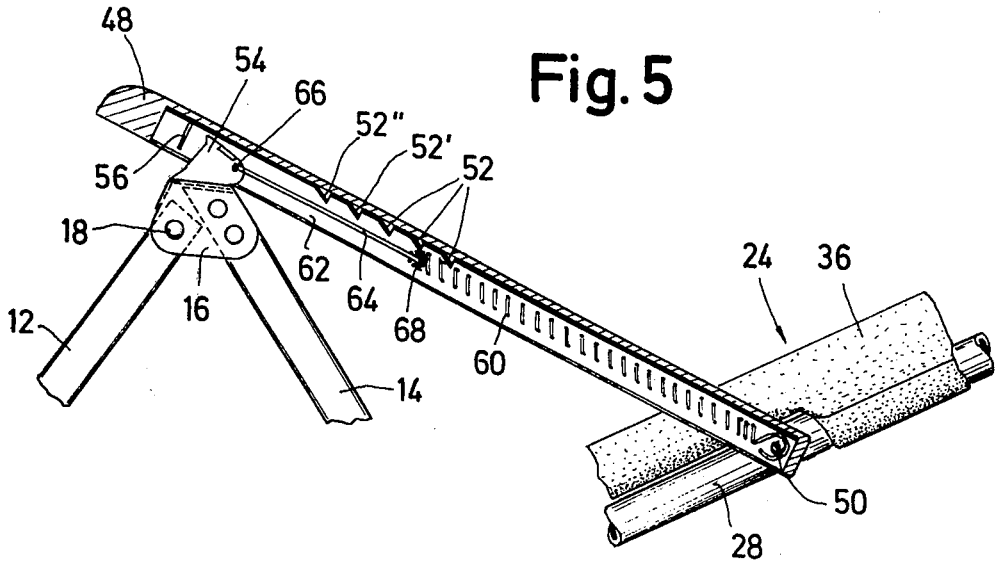
FIG. 5 is a view similar to FIG. 4 in the position assumed when the seat is in the position shown in FIG. 2.

The adjustable chair further includes a pair of armrests 48 which are illustrated in more detail in FIGS. 4 and 5. Each of the armrests 48 is pivoted to the lateral portion 28 of the backrest 24 by means of a pivot 50, and contacts and cooperates with the associated lateral portion 10 of the frame. The backrest 24 can be displaced between an erect position which is shown in FIG. 1 and a fully reclined position which is illustrated in FIG. 2. As seen in more detail in FIGS. 4 and 5, the armrests 48 are internally provided with a plurality of teeth 52, 52', 52'' which are arranged in a row along the armrest 48. The teeth 52, 52', 52'' are accessible from underneath the armrest 48, and the associated lateral portion 10, and more particularly the bracket 16 thereof, is provided with a detent tooth 54 which extends from below into the associated armrest 48. The teeth 52, 52', 52'' are separated by a plurality of detent recesses into which the detent tooth 54 can extend to engage the respective tooth 52, 52', 52'' to arrest the backrest 24 in one of its positions. Preferably, the armrests 48 can be lifted and pivoted about the respective pivots 50 to only such an extent that the detent tooth 54 becomes disengaged from the respective tooth 52, 52' or 52'' so that the backrest 24 and the leg rest 26 can be simultaneously readjusted in their positions.

As clearly seen in FIGS. 4 and 5, the row of the teeth 52, 52' and 52'' extends only over a part of the region in which the armrest 48 can be shifted with respect to the detent tooth 54 of the associated lateral portion 10 of the frame. This region extends from the detent tooth 54 in its position illustrated in FIG. 4 to an abutment 56 which delimits the guide channel for the detent tooth 54 in the front region of the armrest 48. Such region, particularly the length thereof, is indicated in FIG. 4 with a reference numeral *a*. As illustrated, the row of teeth 52, 52', 52'' is provided approximately in the central zone of this region, and may include, for instance, only five of the teeth 52, 52', 52''. In a part of the region *a* which is designated with a reference character *b*, there are provided no teeth so that the armrests 48 can freely move relative to the detent tooth 54 when the latter is in the part region *b*. This, of course, means that the position of the backrest 24 can be freely selected and that the backrest 24 can steplessly move when the detent tooth 54 cooperates with the region *b*.

The adjustable seat of the present invention is so constructed that the movement of the backrest 24, when the detent tooth 54 is in the region *b*, is damped, but it is equally possible that the movement of the backrest 24 can be damped all the way from the erect position to the fully reclined position or during a part of the movement of the backrest 24 which is not coincident with the cooperation of the detent tooth 54 with the part region *b*. The provision of the damping arrangement which will be presently discussed in more detail assures that, even when the above-discussed arresting arrangement is disengaged, the backrest 24 will move towards its fully reclined position without substantial impact, even though the part of the weight of the user of the chair which acts on the backrest 24 increases with the increasing angle which the backrest 24 assumes with respect to the vertical. The damping arrangement, which is designated in toto with a reference numeral 58, includes a tension spring 60 one end of which is affixed to the pivot 50 at which the armrest 48 is pivoted to the backrest 24, which tension spring 60 extends only over a part of a channel 62 which is formed in the lower part of the armrest 48. Preferably, the length of the helical tension spring 60 amounts to less than a third of the length of the channel 62. A connecting rod 64 is telescopically received within the tension spring 60 and has an end portion which extends outwardly of the tension spring 60 and is connected at 66 to the detent tooth 54. The connecting rod 64 has another end portion which carries an abutment 68 which is capable of abutting against and cooperating with the free end portion of the tension spring 60. As a result of the cooperation of the connecting rod 64 with the tension spring 60, the damping arrangement 58 is inactive until the abutment 68 abuts against the end portion of the tension spring 60, so that the backrest 24 can be freely displaced during the initial part of the movement thereof toward its fully reclined position without being hampered by the damping arrangement 58. When the abutment 68 of the connecting rod 64 abuts against the closed free end of the tension spring 60, further movement of the backrest 24 results in tensioning of the tension spring 60 so that the damping arrangement 58 partially or fully counteracts any forces which may be acting on the backrest 24 and directed toward the fully reclined position thereof. Thus, the damping arrangement 58 counters not only the forces resulting from the weight of the user, but also any inertial forces which may result from the movement of the backrest 24 and of the user toward the fully reclined position of the backrest 24 so that soft movement of the backrest 24 toward the fully reclined position thereof is achieved. In the illustrated embodiment of the invention, the damping arrangement 58 is so constructed and dimensioned as to become active for damping the movement of the backrest 24 towards its fully reclined position from the moment on when the detent tooth 54 of the latter portion 10 is aligned with and engages the tooth 52' of the row of teeth 52, 52' and 52''. From this relative position of the teeth 52, 52' and 52'', on the one hand, and the detent tooth 54, on the other hand, the damping arrangement 58 exercises increasing damping effect on the backrest 24 which, in turn, results in soft movement of the backrest 24 from the position corresponding to the engagement of the detent tooth 54 with the tooth 52' toward the engagement of the detent tooth 54 with the abutment 56, and particularly through the part region *b*. The damping arrangement 58 also assures that the impact forces which come into being upon engagement of the detent tooth 54 either with the teeth 52' or 52'' or with the abutment 56 will either be negligible or of only a small magnitude so that, on the one hand, the engagement of the detent tooth 54 with the teeth 52', 52'' or with abutment 56 will not evoke an unpleasant sensation in the user of the adjustable chair and, on the other hand, the wear of the detent tooth 54 and of the teeth 52', 52'' or the end abutment 56 will be kept within acceptable limits. While the arresting and damping arrangements have been discussed above in connection with one of the armrests 48, it is to be understood that the same damping and arresting arrangements may be associated also with the other armrest 48 so as to assure symmetrical action on both sides of the adjustable chair.

Figure 6:
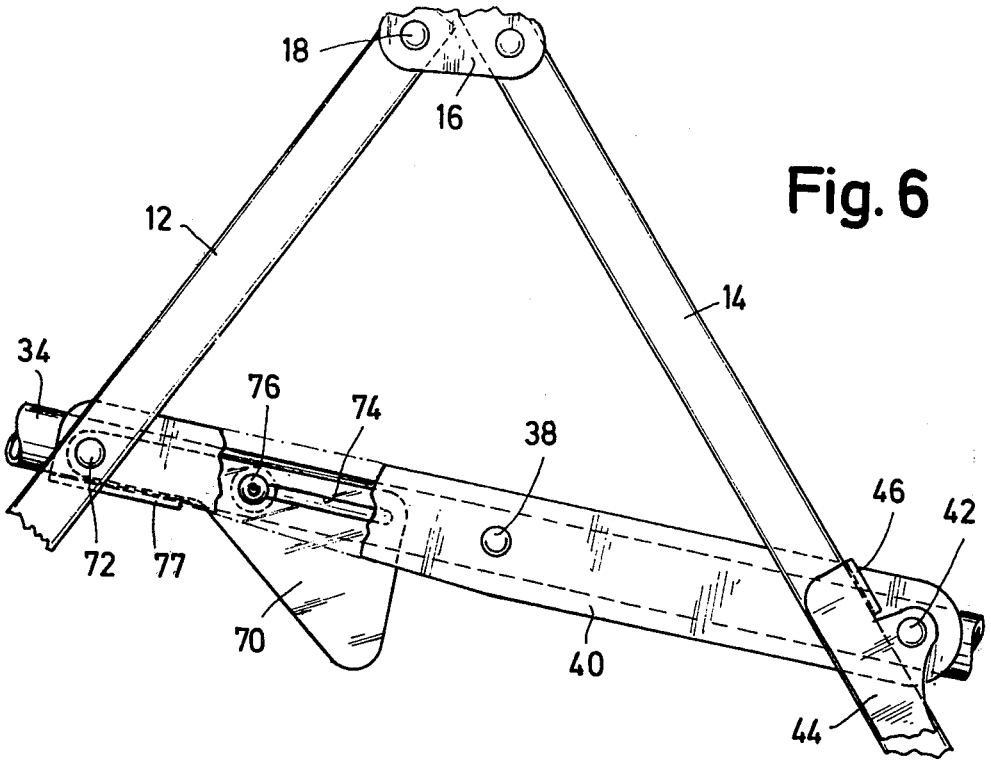
FIG. 6 is a partial side view of the adjustable seat corresponding to the positions assumed in FIGS. 1 and 2 and showing a connecting element.
Figure 7:
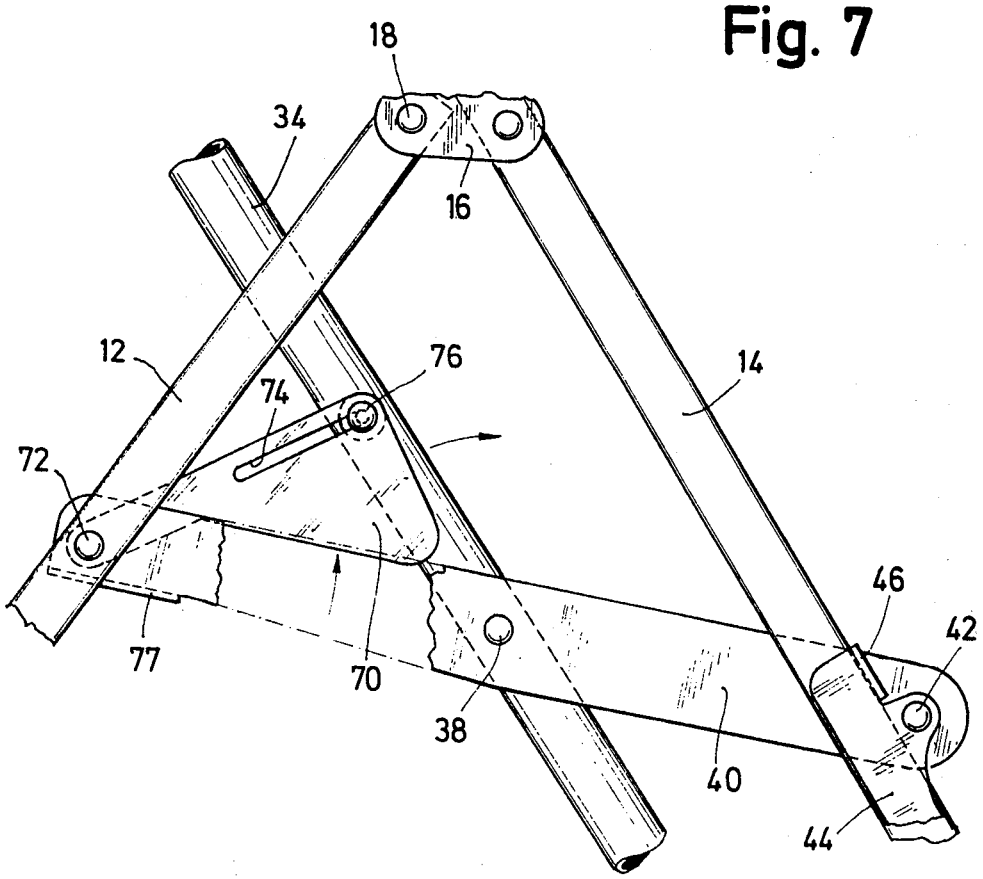
FIG. 7 is a view similar to FIG. 6 in the position corresponding to FIG. 3.

As mentioned above, the seat 22 is mounted on pivots 38 supported in the connecting members 40 for pivoting about an axis which is transverse to the adjustable chair. FIGS. 6 and 7 illustrate in more detail how the seat 22 is pivoted on the connecting member 40. It is to be understood that, when the adjustable seat is in the position illustrated in FIG. 1, the weight of the user of the adjustable chair is so distributed that a force going through the center of gravity of the user of the chair is located frontwardly of the pivot 38. In this manner, it is assured that the assembly 22, 24, 26 will not tend to tilt in the rearward direction. This is also true when the seat is displaced from its position illustrated in FIG. 1 into its fully reclined position shown in FIG. 2 with the result that the seat 22 will remain in its illustrated substantially horizontal position. When it is desired to move the assembly 22, 24, 26 into the position illustrated in FIG. 3, it is necessary that the user of the adjustable chair transfer his center of gravity so that it be located rearwardly of the pivot 38, which can be achieved by lifting and rearwardly displacing the legs of the user. Inasmuch as the force associated with the weight of the user which passes through the center of gravity of the user now acts on the seat 22 rearwardly from the pivot 38, a moment is obtained which results in pivoting of the seat 22 into the position illustrated in FIG. 3 in which the legs of the user are located at a higher elevation than his head. When the center of gravity of the user is appropriately shifted, it is possible to stop the assembly 22, 24, 26 in any position intermediate the positions illustrated in FIGS. 2 and 3, respectively.

Referring now to FIGS. 6 and 7, it may be seen therein that an arrangement for limiting the extent of movement of the seat 22 relative to the lateral portions 10 is provided, such limiting arrangement including a connecting element 70 which is accommodated between the reinforcing member 40 and the respective frame portion 34 of the seat 22 and is pivotably connected to the front leg member 12 by a pivot 72. The connecting element 70 is formed with an elongated slot 74, in which there is received and guided a projecting portion or pin 76 rigidly connected to the portion 34 of the seat 22. In the normal position of the seat 22 which corresponds to that illustrated in FIGS. 1 and 2, an abutment 77 rigid with a front portion of the reinforcing member 40 and extending inwardly therefrom supports the seat 22 in its substantially horizontal position, and the connecting element 70 is in the position which is illustrated in FIG. 6. In this position, the pin 76 is located at the left or front end of the elongated slot 74. When now the seat 20 is moved from the substantially horizontal position illustrated in FIGS. 1 and 2 toward the fully inclined position illustrated in FIG. 3, the pin 76 moves along the slot 74 of the connecting element 70 which results in rotation of the latter about the pivot 72. Finally, when the seat 22 assumes the position illustrated in FIGS. 3 and 7, the pin 76 reaches the other end of the slot 74 so that continuing movement of the seat 22 in the rearward direction is prevented from now on. This construction renders it possible to predetermine the final position of the seat 22 using either only one connecting element 70 and the associated pin 76, or a pair thereof which is arranged to the two sides of the seat 22.

When the assembly 22, 24, 26 is moved into its position illustrated in FIG. 3 from the position illustrated in FIG. 1, it is necessary to disengage the detent tooth 54 from the row of teeth 52, 52', 52'' by lifting the armrest 48, and eventually the damping arrangement 58 becomes active in a manner similar to what has been described previously. Thus, the damping arrangement 58 damps not only the movement of the backrest 24 relative to the seat 22, but also the simultaneous movement of the assembly 22, 24, 26 between the positions illustrated in FIGS. 1 and 3, respectively. Thus, the damping arrangement 58 influences the movements of all of the relatively displaceable or pivotable parts of the assembly 22, 24, 26 so that soft movement of such parts 22, 24, 26 is obtained.

It will be understood that each of the elements described above, or two or more together, may also find a useful application in other types of constructions differing from the types described above.

While the invention has been illustrated and described as embodied in an adjustable chair, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. In an adjustable chair, a combination comprising a frame including a pair of lateral portions; a seat; a backrest; means for connecting said backrest to said frame for movement relative thereto through a series of first positions between an erect and an intermediate position, and through a series of second positions between said intermediate and a fully reclined position; means for arresting said backrest in selected ones of said first positions, including a first arresting member connected to said frame and a second arresting member connected to said backrest for movement therewith relative to said first arresting member, one of said arresting members having at least one detent projection and the other arresting member including an arresting portion juxtaposed with a region of movement of said detent projection relative to said arresting portion which corresponds to the movement of said backrest between said erect and intermediate positions and having a plurality of detent recesses in a selected one of which said detent projection is received to arrest said backrest in a selected first position, whereas said detent projection is outside said region in said second positions of said backrest so that the latter is infinitely adjustable between said second positions; a pair of armrests each associated with one of said lateral portions; a pivot connecting a respective one of said armrests to said backrest; and means accommodated in at least said one armrest and operative for damping said movement of said backrest toward said fully reclined position thereof at least in a range in which said backrest approaches said fully reclined position, said damping means including a helical tension spring having two ends one of which is attached to said pivot, and a connecting rod attached to said associated lateral portion and partially accommodated in said tension spring, said tension spring and said connecting rod having associated abutment portions which are disengaged from one another when said backrest is outside said range and engage one another when said backrest is within said range so that movement of said backrest in said range toward said fully reclined position results in tensioning of said tension spring.

2. In an adjustable chair, a combination comprising a frame; a seat; a backrest; means for connecting said backrest to said frame for movement relative thereto through a series of first positions between an erect and an intermediate position, and through a series of second positions between said intermediate and a fully reclined position; means for arresting said backrest in selected ones of said first positions, including a first arresting member connected to said frame and a second arresting member connected to said backrest for movement therewith relative to said first arresting member, one of said arresting members having at least one detent projection and the other arresting member including an arresting portion juxtaposed with a region of movement of said detent projection relative to said arresting portion which corresponds to the movement of said backrest between said erect and intermediate positions and having a plurality of detent recesses in a selected one of which said detent projection is received to arrest said backrest in a selected first position, whereas said detent projection is outside said region in said second positions of said backrest so that the latter is infinitely adjustable between said second positions; and means for damping said movement of said backrest between a predetermined one of said first, intermediate and second positions which is spaced from said erect position, and said fully reclined position, said damping means including a damping member and an activating member which conduct relative movement with respect to one another during said movement of said backrest and have associated abutment portions which are disengaged from one another when said backrest is outside said range and engage each other when said backrest is within said range to activate said damping member only while said backrest is in said range.

3. A combination as defined in claim 2, wherein said frame includes a pair of lateral portions; wherein said connecting means mounts said backrest between said lateral portions of said frame; and wherein said first arresting member is connected to one of said lateral portions.

4. A combination as defined in claim 3, wherein said second arresting member is an armrest which is connected to said backrest for pivoting between a first position in which said arresting members are disengaged, and a second position in which said arresting members engage one another.

5. A combination as defined in claim 4, wherein said armrest has a row of teeth which project from said armrest toward said first arresting member and define with one another said detent recesses; and wherein said first arresting member has a single tooth which constitutes said detent projection and engages a respective tooth of said row when received in said one detent recess.

6. A combination as defined in claim 5, wherein said arresting means includes additional first and second arresting members similar to said first and second arresting members and associated with the other of said lateral portions of said frame.

7. A combination as defined in claim 2, wherein said frame includes a pair of lateral portions; further including a pair of armrests associated with said lateral portions and connected to said backrest; and wherein said damping and activating means is accommodated in at least one of said armrests and connected to said backrest and to said associated lateral portion, respectively.

8. A combination as defined in claim 7, wherein said damping member is a helical spring one end of which cooperates with said associated lateral portion and the other end of which cooperates with said armrest.

9. A combination as defined in claim 8, further including a pivot connecting said armrest to said backrest; and wherein said other end of said helical spring is attached to said pivot.

10. A combination as defined in claim 2, and further including means for mounting said seat on said frame; and wherein said connecting means includes means for pivotally supporting said backrest on said seat.

11. A combination as defined in claim 10; and further including a leg rest; means for pivotably mounting said leg rest on said seat for movement between a retracted position and an extended position; and means connecting said backrest with said leg rest for movement of the latter between said positions thereof in response to the movement of the former between said angular positions thereof.

12. A combination as defined in claim 10, wherein said frame includes a pair of lateral portions; and wherein said mounting means mounts said seat on said lateral portions for pivoting between a substantially horizontal position and an inclined position.

13. A combination as defined in claim 12; and further comprising means for limiting pivoting of said seat beyond said inclined position when considered in direction from said substantially horizontal position.

14. A combination as defined in claim 13, wherein said limiting means includes at least one connecting member pivotably mounted on one of said lateral portions of said frame and having a closed elongated slot, and a projecting member on said seat, which is received and guided in said elongated slot.

15. A combination as defined in claim 10, wherein each of said lateral portions includes two leg members which are pivotably connected to one another, and a reinforcing member which connects said leg members with one another; and wherein said mounting means mounts said seat on said reinforcing members of said lateral portions.

16. A combination as defined in claim 10, and further including abutment means on at least one of said lateral portions and operative for preventing pivoting of said seat beyond said substantially horizontal position when considered in direction from said inclined position.

17. A combination as defined in claim 9, wherein said activating member is a connecting rod attached to said associated lateral portion and partially accommodated in said spring, and said associated abutment portions are on said spring and said connecting rod.

* * * * *